US006059595A

United States Patent [19]

Lacrouts-Cazenave

[11] Patent Number: 6,059,595

[45] Date of Patent: May 9, 2000

[54] ELECTRICAL CONNECTOR WITH SLIDING CONTACTS

[75] Inventor: Joël Lacrouts-Cazenave, Saint Germain de la Grange, France

[73] Assignee: Compagnie Deutsch, Rueil-Malmaison, France

[21] Appl. No.: 08/750,595

[22] PCT Filed: Jun. 20, 1995

[86] PCT No.: PCT/IB95/00498

§ 371 Date: Dec. 18, 1996

§ 102(e) Date: Dec. 18, 1996

[87] PCT Pub. No.: WO95/35587

PCT Pub. Date: Dec. 28, 1995

[30] Foreign Application Priority Data

Jun. 21, 1994 [FR] France ..... 94 07842

[51] Int. Cl.[7] ..... H01R 13/28

[52] U.S. Cl. ..... 439/289; 439/824

[58] Field of Search ..... 439/289, 700, 439/824, 482

[56] References Cited

U.S. PATENT DOCUMENTS

| | | | |
|---|---|---|---|
| 2,742,626 | 3/1956 | Collins | 439/289 |
| 4,431,242 | 2/1984 | Gisewsky | 439/363 |
| 4,703,986 | 11/1987 | McCormick | 439/289 |
| 4,778,404 | 10/1988 | Pass | 439/289 |
| 4,906,205 | 3/1990 | Miles | 439/289 |
| 5,540,599 | 7/1996 | Bishop | 439/289 |

FOREIGN PATENT DOCUMENTS

| | | |
|---|---|---|
| 0009314 | 4/1980 | European Pat. Off. . |
| 0256541 | 8/1987 | European Pat. Off. . |
| 3600456 | 7/1987 | Germany . |
| 94/11925 | 5/1994 | WIPO . |

*Primary Examiner*—Hien Vu
*Attorney, Agent, or Firm*—Henderson & Sturm

[57] ABSTRACT

An electrical connector including a support member having a socket or opening to receive a contact member including facing and contacting male and female elements. At least one of the male and female elements comprises a head and integral corrugated resilient tab portion which urges the head into contact with the contact member. The contact member and one of the male and female elements includes a body portion integral with the tab portion forming a hollow tubular guide for the head portion, and a connecting portion remote from the head portion, for connection to an electrical conductor.

17 Claims, 4 Drawing Sheets

ELECTRICAL CONNECTOR WITH SLIDING CONTACTS

CROSS REFERENCE TO RELATED APPLICATIONS

This application is the U.S. National Stage of International Patent Application No. PCT/IB95/00498, filed Jun. 20, 1995; with a Claim For Priority based on Appln. No. FR 94 07842, filed Jun. 21, 1994.

BACKGROUND OF THE INVENTION

1. Field of the Invention

A connector is formed from two supporting elements optionally forming housings each carrying a set of contacts, each contact in the set of one element cooperating with a contact in the set of the other element.

2. Description of the Related Art

A first type of contact is produced in the form of pins and sockets, that is a male contact sliding in a female contact. This sliding involves long travel for installation, insertion forces which become relatively high if there is a large number of contacts, low, variable contact forces (relaxation during high temperature cycles, limited contacting surfaces, reliable connector locking systems and sensitivity to corrosion "fretting" due to micro-sliding between contacts).

Another type of contact is slidably mounted in a socket of its supporting element while being pulled outwardly by a resilient return means and is located opposite a contact of the other element which it can meet with its front face. Such contacts are described, for example, in the documents U.S. Pat. No. 4,431,242, U.S. Pat. No. 2,742,626, WO-A-94/11925, EP-A-0 256 541 and EP-A-0 009 314.

When two connector elements are fitted together, each of the contacts of one element pushes back the corresponding contact of the other element and itself returns into its accommodating socket against the action of its return spring. The two contacts are thus in contact with one another with a pressure which may be significant and which is insensitive to temperature variations. There is no relative displacement between the two contacts which would produce wear during assembly. The connecting travel may be very short, facilitating installation.

If desired, the front faces of the contacts are spherical in shape, the contacts of one of the elements being concave and those of the other being convex, as illustrated in the documents U.S. Pat. No. 4,431,242 or U.S. Pat. No. 2,742,626. Self-centring of the contacts therefore takes place and prevents micro-sliding of the contacting surfaces on one another.

The resilient return means of the contact preferably consists of a corrugated tab integral with the contact, as illustrated in the documents WO-A-94/11925, EP-A-0 256 541 or EP-A-0 009 314. In this way, the contact and its spring can be produced economically from the same starting member. In particular, contacts involving individually attached springs such as those described in the documents U.S. Pat. No. 4,431,242 and U.S. Pat. No. 2,742,626 necessitate expensive supporting elements because they inevitably consist of several assembled parts to allow the installation first of the contacts then of the springs and finally the locking thereof by an attached part. This assembly is also very inconvenient.

In the complete connector, the corrugated tab can be either with the male contact or with the female contact or with both together. Resilient connection is ensured if at least one of the two contacts has this corrugated tab. The resilient contact can be applied directly to a mating surface formed on a conducting part.

However, integral contacts with their spring tabs as described in the documents WO-A-94/11925, EP-A-0 256 541 or EP-A-0 009 314 pose other problems. The first is the problem of necessarily fixing them on the back of the spring tab to respect the range of elasticity but which may not be an advantageous point of the socket. A further problem is that of their effective sliding within the socket, in particular if this contact risks rubbing and attaching itself to the internal walls of the socket which are still slightly rough if the supporting element is produced from plastics material.

The present invention relates to a connector which overcomes these drawbacks.

SUMMARY OF THE INVENTION

The object is achieved with a connector comprising two elements in each of which contacts are formed by a head mounted so as to slide against the action of a corrugated tab integral with the head, each contact of an element cooperating with a contact of the other element opposite which it is located and which it can meet with its front face, in that that corrugated tab is in turn integral with a body in which the head of the contact can slide and which is extended at its end remote from the head by a part for connection to an electrical conductor.

Although delicate, this design of a body forming an integral volume with the contact head and its spring tab of the same material, preferably from a strip of smooth metal, with dimensions predetermined exactly with respect to those of the head and the spring tab forms a casing within which these essential elements of the contact travel with minimum friction while being perfectly guided. The dimensions of the sockets of the support containing the contact do not necessarily have to be perfect and this greatly simplifies the moulding of these supporting elements, reducing their cost. The risk of parasitic electrical resistance to the passage of current between the contact head and the wire directly welded or crimped to a rear connecting lug of the body has also been eliminated in this way.

Advantageously, the body can have outwardly folded tabs capable of abutting against a shoulder of the compartment for accommodating the contact in the element and/or can have outwardly folded resilient retaining tabs engaging behind a shoulder of the socket after a contact has been positioned in its socket and preventing loss of contact.

Alternatively, the body can have one or more notches in which one or more parts for locking the contact in its socket of the element are then inserted. To complement the arrangement, the body can have one or more external brackets for the preliminary holding of the contact in its socket of the element by friction.

In other words, the existence of this body provides a very large surface for the arrangement of powerful means for fastening the spring tab and the head in the socket. Depending on the configuration of a connector support or housing for a given application, the fastening means can be arranged more or less forward on the body to optimise its catching and its hold whether definitively or removably. Furthermore, these fastening means can just as easily be male in the form of outwardly folded tabs as female in the form of notches made only in the thickness of the body so as not to interfere with the displacement of the internal corrugated tab.

Usefully, the body has a polygonal section and each of its faces is stiffened by an internal rib. Stamped dishes can also be provided in the bottom of the corrugations of the tab.

Particularly small contacts can therefore be produced from thin strip, the essential parts being reinforced by structuring, the sliding friction being reduced to that of a plane against a rib.

Again usefully, the body can have an inwardly folded tab supporting the last corrugations of the tab. This body can also have, in its front orifice, a tab which is folded into the head acting as a travel-limiting stop and contributing to the stiffness of the body.

Owing to the presence of this body, stops for limiting the travel of the spring tab can easily be produced, allowing the elasticity necessary for a good contact to be maintained for a long period.

The corrugated tab can be cut out in the centre of a blank or strip format from which the contact is formed or can preferably be arranged laterally relative to the blank from which the contact is formed.

A first process for producing the contact can involve cutting a blank from a strip in a format comprising a rear part for connection to a cable and a front body part which is initially substantially rectangular and is separated by a longitudinal median cut, this blank being completed on one side of the front part by a longitudinal tab attached by a lateral lug, structuring the front part to reveal future means for fastening the body in the socket, raising the lateral edge of the front part remote from that adjacent to the longitudinal tab, shaping the contact head and its corrugated tab in the longitudinal tab, independently of the preceding stage, then folding the lateral lug to return into the adjacent half shell, and raising the two lateral edges of the rear part which leads to the raising of the two half shells of the body and their closure round the contact head and its corrugated tab.

A further preferred embodiment involves cutting a blank from a strip in a format comprising a rear part for connection to a cable and a front body part which is initially substantially rectangular and is separated by a longitudinal median cut, this blank being completed on one side of the front part by a longitudinal tab attached by a lateral lug, structuring the front part to reveal future means for fastening the body in the socket, raising the lateral external edges of the front part and the internal edges of the median cut to form two half shells, shaping the contact head and its corrugated tab in the longitudinal tab, independently of the preceding stage, then folding the lateral lug to return into the adjacent half shell, and raising the two lateral edges of the rear part which leads to the raising of the two half shells of the body and their closure round the contact head and its corrugated tab.

These processes also solve the awkward problem of producing a three-dimensional body surrounding an internal spring tab which is also three-dimensional and which is not to be deformed, as this would affect its elasticity.

BRIEF DESCRIPTION OF THE DRAWINGS

An embodiment of the connector according to the invention is described hereinafter as a non-limiting example with reference to the accompanying drawings.

DESCRIPTION OF THE PREFERRED EMBODIMENTS

Figure 2:
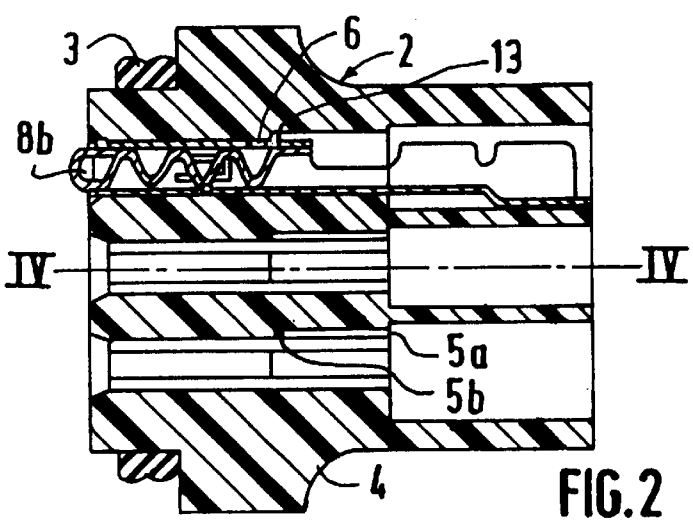
FIG. 2 is a cross section of the male element of the connector.
Figure 1:
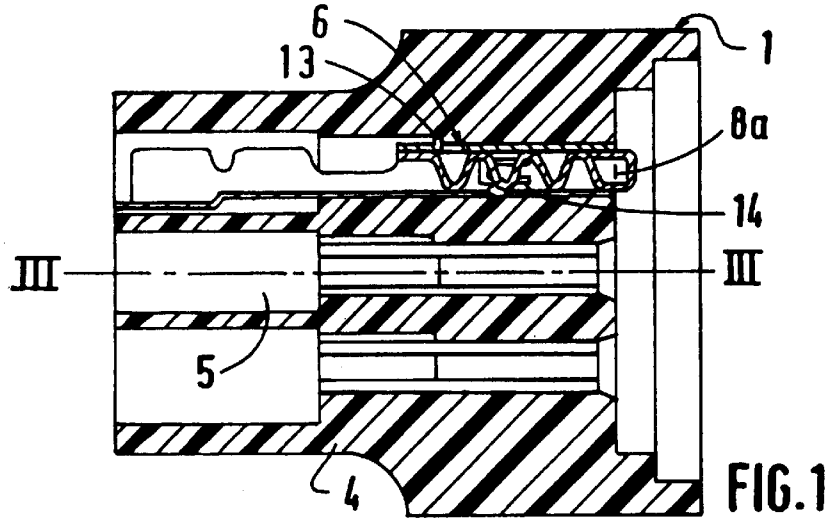
FIG. 1 is a cross section of the female element of the connector.
Figure 4:
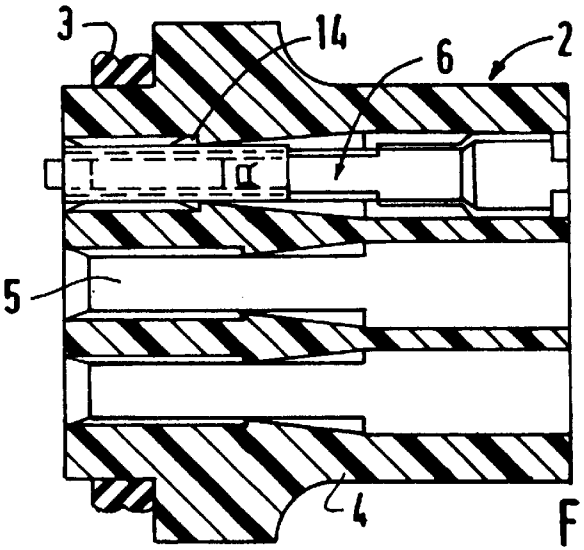
FIG. 4 is a cross section along IV—IV in FIG. 3.
Figure 3:
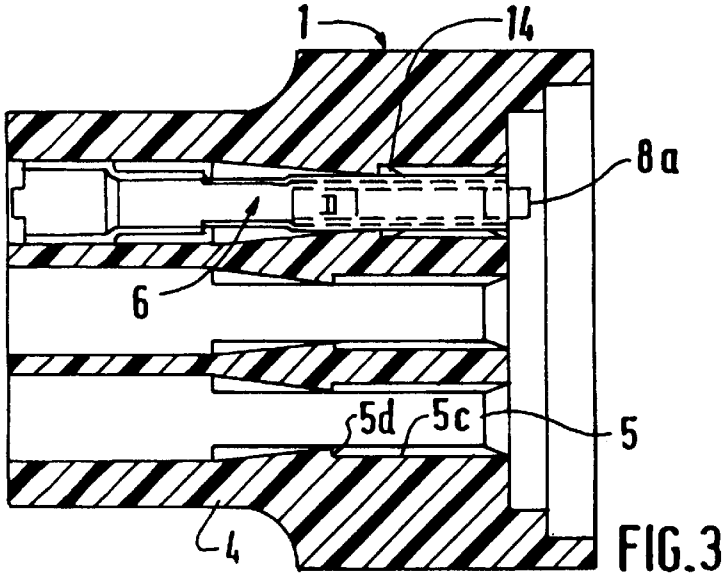
FIG. 3 is a cross section along III—III in FIG. 1.

As illustrated in the drawings, the connector according to the invention comprises a female connector housing element 1 and a male element 2 cap able of fitting partially in the element 1, with interposition of a gasket 3. Means not shown integrated in the elements 1 and 2 or consisting of a complementary part can be provided to lock the two elements 1 and 2 which are fitted together.

The male element 2 and the female element 1 each consist of an insulating shell 4 of plastics material in which sockets 5 are moulded and contain contacts 6, of which there are nine in the embodiment illustrated. Each socket 5 has, at its internal end, a longitudinal groove 5*a* which is connected to the socket by a shoulder 5*b*. At its other end it comprises two diametrically opposed longitudinal grooves 5*c* which are connected to the socket by shoulders 5*d*.

Each of the contacts 6 is a copper alloy possibly covered by a corrosion-preventing metallic layer, for example of tin, nickel or gold cut out in a strip 7 (FIGS. 5, 10 and 12) then folded. A contact 6 comprises an external head 8*a* or 8*b* which is connected by a corrugated tab 9 to a body 10 for guiding the head. This body is extended at its end remote from the head by a rear connecting part 11 which can be fixed to a conductor, for example by crimping, welding or stapling.

The head 8*a* of a contact of the female connector 1 has a convex spherical shape whereas the head 8*b* of a male connector contact has a concave spherical shape with the same curvature as the head 8*a*.

The body 10 has a square section and each of its faces is stiffened by an internal rib 12 which stiffens it, allowing better sliding of the corrugations of the tab 9 and completing the electrical conducting surfaces. It also has outwardly folded tabs 13 intended to abut against the shoulder 5*b* of a socket 5 and resilient retaining tabs 14 also folded outwardly and engaging, after the contact has been positioned, behind the shoulder 5*d* of the socket, and preventing removal of the contact from it.

Figure 8:
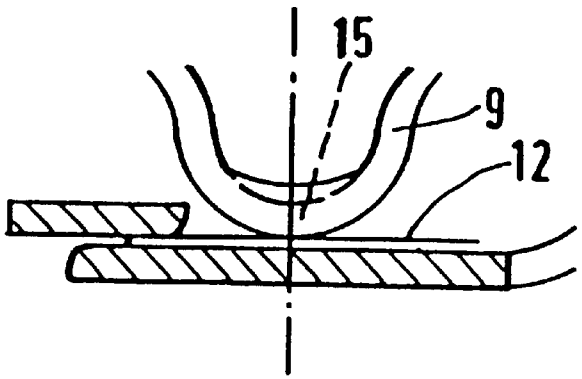
FIG. 8 is a section through a detail of a contact.

In the bottom of the corrugations of the tab 9 there are provided stamped dishes 15 (FIG. 8) which stiffen this bottom, increase its rigidity and finally prevent the corrugations from jamming in the shaping members of the body 10. An inwardly folded tab 16 supports one of the last corrugations of the tab 9 while allowing the compression of the other corrugations.

When a contact 6 is installed in a socket 5, its corrugated tab 9 forms a spring and tends to displace the head 8*a* or 8*b* outwardly. The more or less great number of corrugations of the tab 9 allows a greater or smaller reserve for good contact pressure and allows the phenomena of relaxation over time to be rectified. Thus, when the female connector 1 and the male connector 2 are fitted together, the convex head 8*a* of a female connector contact 1 is applied to the concave head 8*b* of the corresponding male connector contact. The spherical shape of these heads produces a relatively large contact surface and the self-centring thereof. Furthermore, it eliminates relative sliding of the two contacting surfaces. The locking travel of the two connector elements is easily smaller than 2 mm whereas it is at least trebled in a conventional connector.

Figure 5:
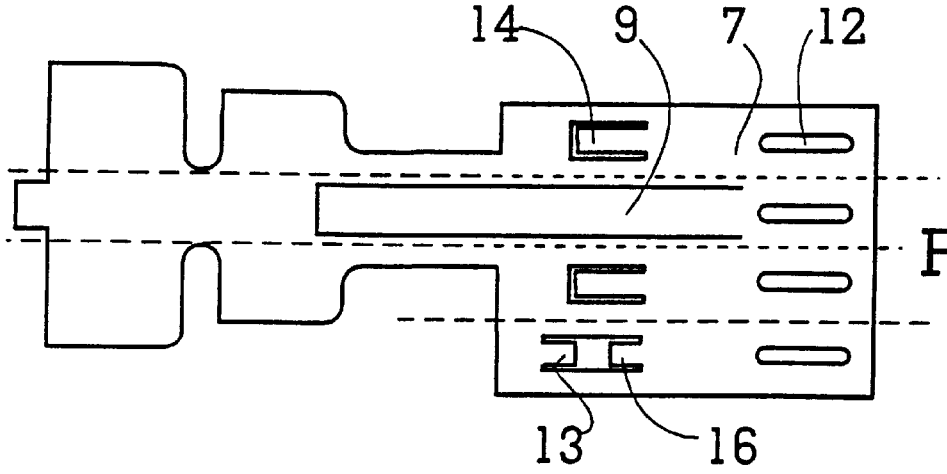
FIG. 5 is a plan view of a blank from which a contact is produced.
Figure 10:
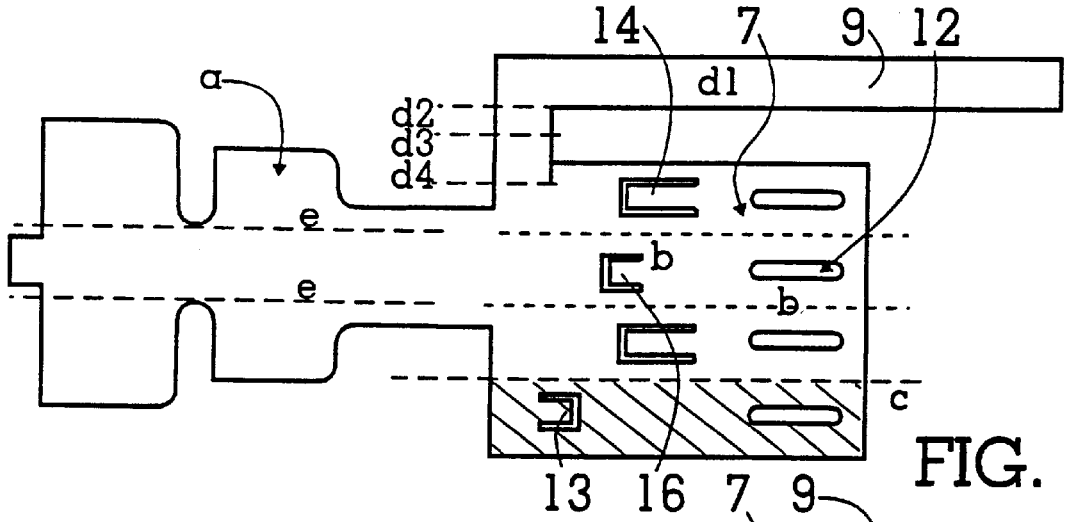
FIG. 10 is a plan view of a variation of the blank from which the contact is produced.

The tab 9 can be cut out in the centre of the blank from which the contact is formed, as shown in FIG. 5, or can be lateral to this blank as shown in FIG. 10. This second solution allows a larger number of corrugations to be made in the tab.

Figure 6:
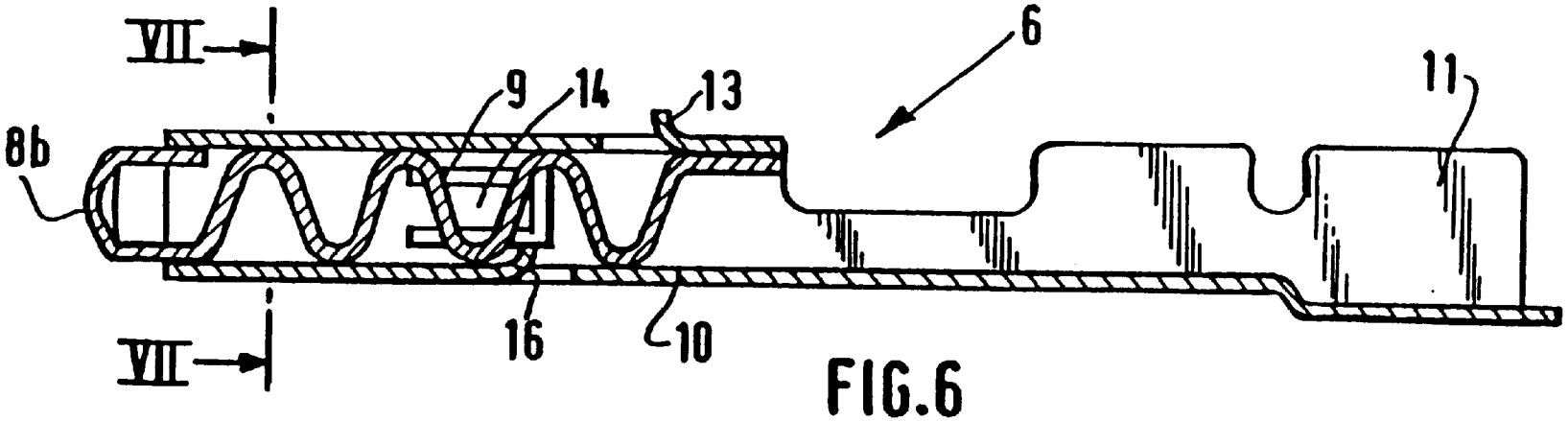
FIG. 6 is a longitudinal section of a contact.
Figure 7:
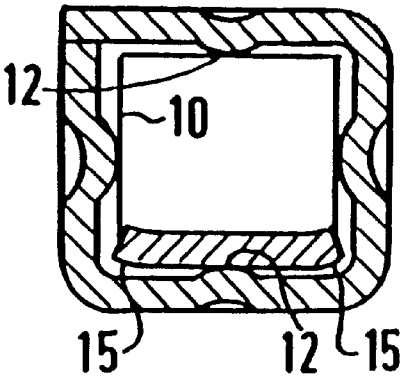
FIG. 7 is a cross section along VII—VII in FIG. 6.
Figure 9:
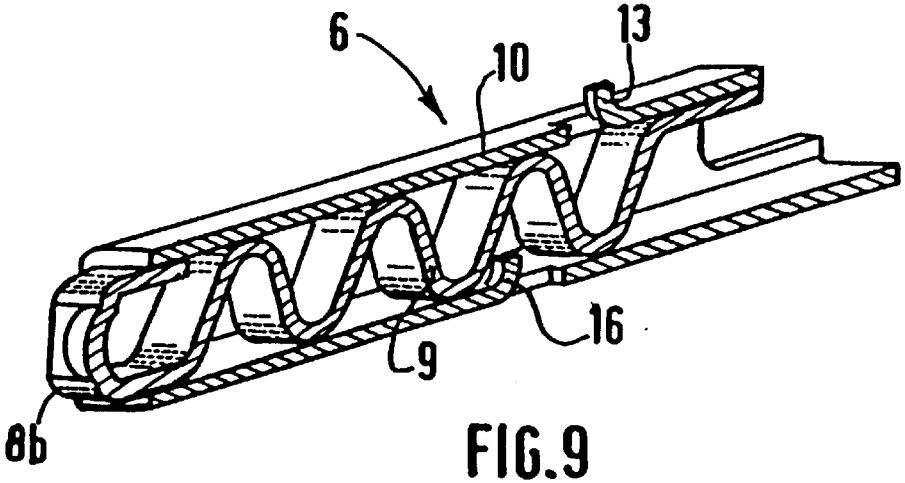
FIG. 9 is a broken away perspective view of a contact.

A process for producing the contact illustrated in FIGS. 6 and 7 begins with the cutting (a) of a blank in the format illustrated in FIG. 10 from a metal strip. This format has a left-hand portion substantially in the form of a double T intended to become the rear part for connection of the contact to the cable, a substantially rectangular right-hand part intended to become the body surrounding the contact and a longitudinal tab connected to the back of the front part by a lateral lug and intended to become the contact head with its corrugated spring tab.

One or more stamping operations (b) then allow the creation of the ribs 12, the rear travel-limiting internal spring tab 16 and the rear tabs 14 and front tabs 13 for fastening the future body in its socket.

A first operation (c) of folding at right angles allows the lower edge, labelled by hatching, of the front portion containing the fastening tab 13 to be raised upwardly. This edge is intended to become the future upper face of the contact, as illustrated in FIGS. 6 and 7.

Corrugations are formed (d1) now or prior to the preceding operation, successively in the longitudinal tab from its end close to its lateral attaching lug in order thus to produce the spring tab 9. The contact tongue 8 is finally produced at the other end of this longitudinal tab.

The spring tab 9 with its head is then turned back above the blank as the result of three folds (d2, d3, d4), the peaks of the corrugations being parallel to the first previously raised edge after such a rotation through 270°.

The two edges of the rear part are then raise simultaneously by a double fold (e) causing the lateral walls of the front body to rise in a fold in the extension of those of the rear part. The first raised edge therefore reaches the horizontal and forms the upper face which abuts against the upper end of the corresponding lateral wall. If necessary, a die may be closed laterally to confirm the position of the lateral walls and the upper wall and thus to give the body its final shape.

It has been noted that, as the raising of the lateral walls is triggered by mere action on the rear part, the spring tab does not run the risk of deformation during this operation.

Figure 12:
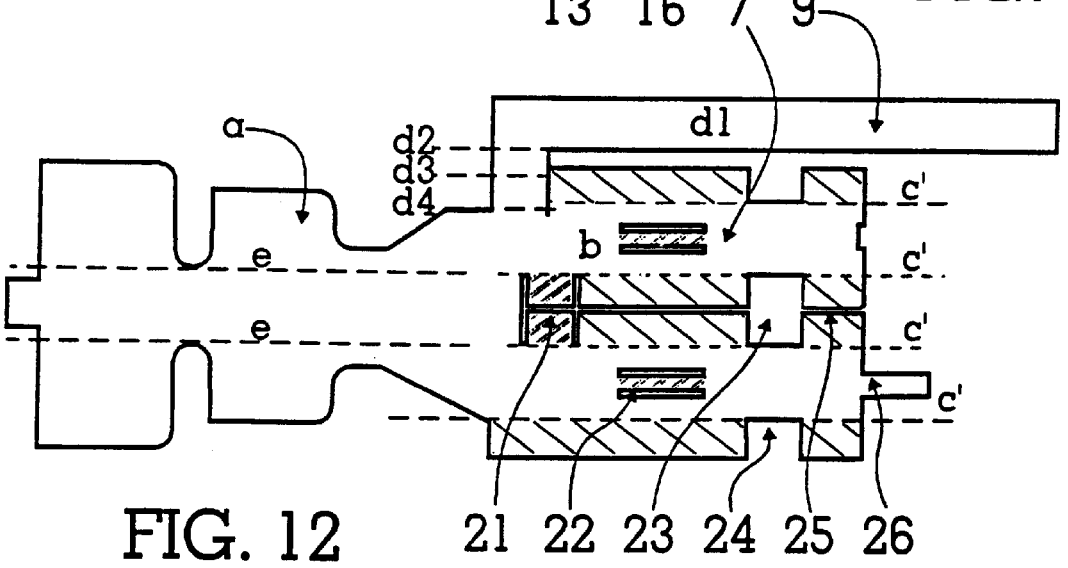
FIG. 12 is a plan view of a second variation of the blank from which the contact is produced.

FIG. 12 shows a variation of the blank format in which the front part is previously sheared off to reveal a median longitudinal cut 25. Then, after formation of the fastening structures 21 and 22 and before or after the production of the spring tab 9, a quadruple fold (c') is simultaneously made toward the top of the external edges of the front part and the internal edges of the cut 25, these edges being labelled by hatching in this FIG. 12. These four edges therefore form two upper face halves and two lower face halves. Two half shells linked to the connecting part by a rear bridge are now present. After the spring tab has been turned back by a triple fold (d2, d3, d4) inside the adjacent half shell, the body is closed during the formation of the rear part by a following double fold (e).

This FIG. 12 shows variations of means for fastening the body in its socket. In this instance, the rear stop tab 21 is transversal relative to the tab 13 in FIG. 10. Furthermore, the fastening tabs 14 are replaced by two traversing notches made in the thickness of the upper and lower walls of the contact, these notches initially appearing as cut-outs 23 and 24 in the blank strip. In order to hold the contact temporarily in its socket before insertion of a part for retention in the notches, two brackets 22 protruding from the exterior of the contact can be provided to rub against the internal wall of the socket.

The good alignment of the half shells can be confirmed by a lug 26 protruding from the end of one of the lateral faces of the body, this lug being intended to traverse the contact head and to be inserted in a mating wedging notch made in the edge of the other lateral face.

Figure 11:
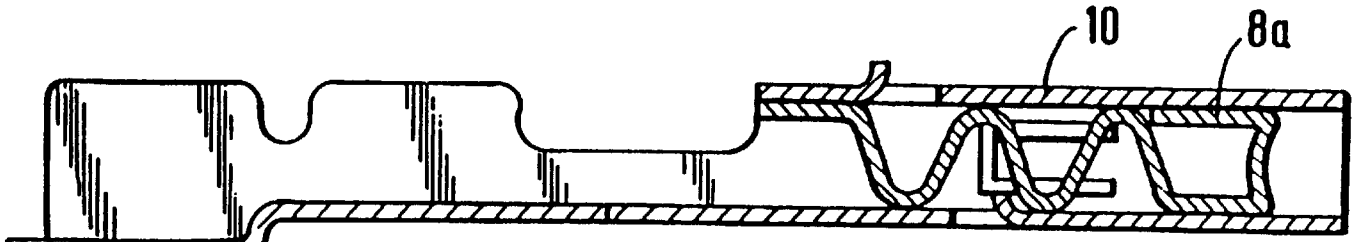
FIG. 11 is a longitudinal section of a variation of a contact of the female element of the connector.

In the embodiment in FIGS. 1 to 9, the heads 8*a* and 8*b* project at rest relative to the body 10 of the contact. However, it is possible for the heads 8*a* of the contacts of the element not to project as shown in FIG. 11 whereas the heads 8*b* of the contacts of the other element do project. When the two connector elements are assembled, the heads 8*b* penetrate in the body of the contacts of the other element and enter this body while improving guidance and the contact surface.

It will be appreciated that the present invention is not limited to the embodiment described and illustrated but, on the contrary, covers all variations.

What is claimed is:

1. A connector comprising a female element and a male element partly engagable into said female element, each said element comprising:

a) a support member made of an insulating material and having at least one socket for accommodating therein a conduct contact member;

b) said conductive contact member accommodated in said socket of said element;

said conductive contact member of said male element and said conductive contact member of said female element mutually facing and contacting each other when said male element is engaged into said female element, and said conductive contact member of at least one of said male and female elements comprising:

i) a conductive head portion which can slide in said socket of said at least one of said male and female elements, ii) a conductive tab portion which is integral with said conductive head portion and has a corrugated shape so as to be able to act as a resilient means for urging said conductive head portion into contact with said conductive contact member of the other of said at least one of said male and female elements;

wherein said conductive contact member of said at least one said male and female elements further comprises:

iii) a conductive body portion which is integral with said conductive tab portion at an end thereof and forms a hollow tubular guide for said head portion, iv) a conductive connecting portion which is integral with and extends said hollow tubular body portion at an end thereof remote from said conductive head portion, for connection to an electrical conductor; and wherein said hollow tubular body portion comprises an inwardly folded tab extending inside the hollow body portion, said inwardly folded tab supporting corrugations of the tab portion and being at an end of the corrugated tab portion.

2. The connector according to claim 1, wherein said hollow tubular body portion comprises outwardly folded tabs capable of abutting against a first shoulder of said socket for accommodating said conductive contact member in said support member.

3. The connector according to claim 1, wherein said hollow tubular body portion comprises outwardly folded resilient retaining tabs engaging, after said conductive contact member has been positioned in said socket, behind a second shoulder of the socket, thereby preventing loss of said conductive contact member.

4. The connector according to claim 1, comprising stamped dishes provided in a bottom of corrugations of the corrugated tab portion.

5. The connector according to claim 1, wherein said hollow tubular body portion comprises, in a front orifice, a tab which is folded into said head and acts as a travel-limiting stop.

6. The connector according to claim 1, wherein said corrugated tab portion is arranged laterally relative to a blank from which said conductive contact member is formed.

7. A process for producing the connector according to claim 1, said process comprising the steps of (a) cutting from a strip a blank in a format comprising a rear part for connection to a cable and a front body part which is initially substantially rectangular and is separated by a longitudinal median cut, said blank being completed on one side of the front part by a longitudinal tab attached by a lateral lug, (b) structuring the front part to reveal future means for fastening said body in the socket, (c) raising lateral external edges of the front part and the internal edges of the median cut to form two half shells, (d) shaping the contact head and its corrugated tab in the longitudinal tab, independently of said preceding step (c), then folding the lateral lug to return into the adjacent half shell, and (e) raising the two lateral edges of the rear part which leads to the raising of the two half shells of the body and their closure round the contact head and its corrugated tab.

8. The connector according to claim 1, wherein said hollow tubular body portion comprises a polygonal section and has faces, each said face being stiffened by an internal rib.

9. The connector according to claim 8, wherein said hollow tubular body portion comprises outwardly folded tabs capable of abutting against a first shoulder of said socket for accommodating said conductive contact member in said support member.

10. The connector according to claim 9, wherein said hollow tubular body portion comprises outwardly folded resilient retaining tabs engaging, after said conductive contact member has been positioned in said socket, behind a second shoulder of the socket, thereby preventing loss of said conductive contact member.

11. The connector according to claim 9, wherein said hollow tubular body portion comprises at least one notch in which said at least one notch member for locking said conductive contact member in said socket of said support member is subsequently inserted.

12. The connector according to claim 9, wherein said hollow tubular body portion comprises an external bracket for a preliminary holding of said conductive contact member in said socket of said support member by friction.

13. The connector according to claim 9 comprising stamped dishes provided in a bottom of corrugations of the corrugated tab portion.

14. The connector according to claim 9, wherein said hollow tubular body portion comprises, in a front orifice, a tab which is folded into said head and acts as a travel-limiting stop.

15. The connector according to claim 9, wherein said corrugated tab member is arranged laterally relative to a blank from which said conductive contact member is formed.

16. The connector according to claim 1, wherein said hollow tubular body portion comprises at least one notch in which said at least one notch member for locking said conductive contact member in said socket of said support member is subsequently inserted.

17. The connector according to claim 16, wherein said hollow tubular body portion comprises an external bracket for a preliminary holding of said conductive contact member in said socket of said support member by friction.

* * * * *